United States Patent [19]

Dropsy

[11] Patent Number: 4,722,474

[45] Date of Patent: Feb. 2, 1988

[54] MOISTURE AND GAS-TIGHT PACKAGE THAT CAN BE SEALED BY A FILM OF THERMOPLASTIC MATERIAL

[75] Inventor: Philippe Dropsy, Talence, France

[73] Assignee: Societe Continentale du Carton Ondule Socar, Saint Mande, France

[21] Appl. No.: 826,127

[22] Filed: Feb. 4, 1986

[30] Foreign Application Priority Data

Feb. 4, 1985 [FR] France ..... 85 01492

[51] Int. Cl.[4] ..... B65D 5/56

[52] U.S. Cl. ..... 229/125.35; 220/405; 220/410; 220/462; 229/169; 229/172; 229/3.1

[58] Field of Search ..... 229/43, 143, 169, 172, 229/3.1; 220/403, 405, 408, 410, 460–462, 454, 457, 359

[56] References Cited

U.S. PATENT DOCUMENTS

| | | | |
|---|---|---|---|
| 2,660,362 | 11/1953 | Schilling | 229/43 |
| 2,688,430 | 9/1954 | Brock | 220/405 |
| 2,737,336 | 3/1956 | Moore | 229/43 |
| 3,430,803 | 3/1969 | Nelson | 220/405 |
| 3,514,012 | 5/1970 | Martin | 220/461 |
| 3,526,186 | 9/1970 | Cornelius | 220/461 |
| 3,866,816 | 2/1975 | Bemiss | 220/462 |
| 3,927,821 | 12/1975 | Dunning | 220/462 |
| 4,056,221 | 11/1977 | Piltz et al. | 220/461 |
| 4,202,465 | 5/1980 | McLaren | 229/15 |
| 4,469,258 | 9/1984 | Wright et al. | 229/43 |

FOREIGN PATENT DOCUMENTS

| | | | |
|---|---|---|---|
| 695400 | 10/1964 | Canada | 220/405 |
| 1515445 | 3/1967 | France . | |
| 2416850 | 10/1979 | France | 220/462 |
| 2057398 | 4/1981 | United Kingdom . | |
| 2110186 | 6/1983 | United Kingdom . | |
| 2137168 | 10/1984 | United Kingdom . | |

*Primary Examiner*—Stephen Marcus
*Assistant Examiner*—Gary E. Elkins
*Attorney, Agent, or Firm*—Scully, Scott, Murphy & Presser

[57] ABSTRACT

A moisture-resistant package of the type which is in the form of a tray, constituted of a semirigid material such as corrugated cardboard, and including a bottom (10) and side walls (14, 16) articulated by fold lines to the bottom, and at least two horizontal flange members (24) articulated by fold lines along the upper edges of at least two of the side walls and extending toward the interior of the package in parallel with the bottom. The package includes an impermeable internal lining (28) constituted of a film of thermoplastic material which is applied by thermal molding against the interior faces of the bottom and side walls and which extends without discontinuity against the under face of the flange members (24) and folds over to apply against the upper face of the flange member.

9 Claims, 5 Drawing Figures

MOISTURE AND GAS-TIGHT PACKAGE THAT CAN BE SEALED BY A FILM OF THERMOPLASTIC MATERIAL

BACKGROUND OF THE INVENTION

The present invention is directed to a package comprising a semirigid material, for example, corrugated cardboard, wherein said package is provided at the top with at least two horizontal copings which form a support surface for another package when a number of the packages are stacked.

Patent GB-A-2,057,398 teaches a packing comprising a bottom on which fold lines articulate two transverse sidewalls and two longitudinal side walls prolonged at their ends by wing pieces that line the transverse walls and thus reinforce the stacking strength of the packing and, two horizontal copings articulated by fold lines along the upper edges of the longitudinal walls extending parallel to the bottom toward the interior of the tray.

It is obvious that when such a packing is made of corrugated cardboard it cannot be used to pack wet commodities or ones that sweat heavily, such as fresh fish, meat products and fresh fruits and vegetables.

French Pat. No. 1,515,445 and U.S. Pat. No. 3,866,816 both describe a means of water-proofing the interior of a cardboard packing in the form of a boat, said means consisting of a protective film of thermoplastic material extending with no discontinuity over the inner faces of the packing, which is adhered to the latter by application of heat or by means of a thermoplastic binder. To produce such a package, the original sheet of cardboard is placed in a mold with its side walls erect, and the film of thermoplastic material is introduced in the heated state by suction or blowing on the inside of the ready-mounted cardboard sheet. The film is then adhered onto the sheet.

It is the aim of the present invention to embody a protection of this type for a package provided with inwardly foldable flaps or flange members. The package is characterized in that it comprises a lining constituted by a film of thermoplastic material that is applied by thermal molding against the inner faces of the bottom and of the side walls and which, without discontinuity, extends against the under face of the inwardly folded flange member and is folded over the free inner edge thereof to apply against the upper face of the flange member.

Any thermoplastic film can be used within the scope of the invention. Note, however, that if the film is semirigid, for example of the polystyrene type, it is not necessary to adhere it to the cardboard walls because the lining is self-locking inside the cardboard packing. As a matter of fact, if an attempt is made to extract the entire lining from the packing, by pulling, for example, on the flanges of the lining covering the upper face of the inwardly folded flange member, the latter will counteract this withdrawal by the fact that the lining has an inner cross section larger than that of the opening defined between the flange members on the opposite end of the package.

But, if the thermoplastic film is flexible and easy to crush, it must be adhered to the walls of the cardboard packing. With this in mind, it is possible either to use a plastic film, one face of which has an adhesive agent that is reactivated when the film is heated to permit its thermal molding, or to imprint on the inner surface of the cardboard, zones of adhesive coating that are reactivated at the time of the thermal molding.

It is also possible to reinforce the integration between the lining and the cardboard packing by forming apertures in the flange members through which the portions of film situated on the opposite faces of the flange members become welded together during the thermal molding.

The thermoplastic material of the film must be of food grade so it will not alter the tase of the foods packed therein. The thickness of the film can be comprised between 100 and 500 $\mu$m.

According to another characteristic of the invention, the strips of film covering the outer faces of the flange members and the thicknesses of the other walls of the packing extend beyond the outside of the latter to form a peripheral flange on which a cap of thermoplastic material can be heat-sealed to insure that the package is perfectly sealed with respect to the ambient medium.

In another embodiment of the invention, the cardboard packing is also protected by an outer lining of thermoplastic material having the form of a shell applied against the outer faces of the bottom and the side walls of the packing and terminating at its upper edge in a peripheral flange parallel to the bottom and projecting laterally outward, the peripheral portion of the inner lining that covers the outer faces of the flange members and the upper edges of the other walls of the packing also extending outside beyond the latter to form a projecting peripheral flange, the said flanges of the outer shell and of the inner lining being heat-sealed together.

By reason of its double external and internal protection, the packing is impermeable both with respect to the commodities it contains and to outside agents.

BRIEF DESCRIPTION OF THE DRAWINGS

A form of embodiment of the invention will now be described by way of a nonlimiting example, with reference to the attached drawings in which.

DETAILED DESCRIPTION OF THE INVENTION

Figure 1:
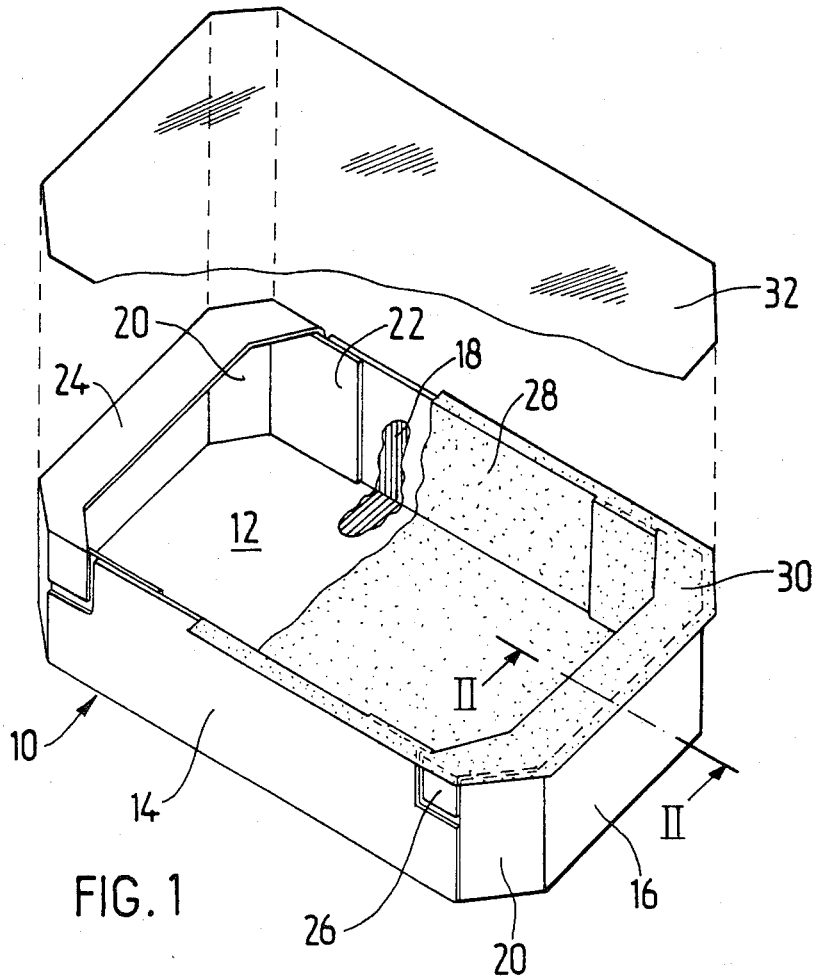
FIG. 1 is a perspective view of a first example of package made impermeable on the inside by a film of thermoplastic material.
Figure 2:
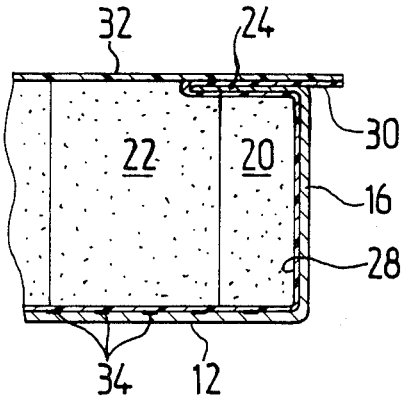
FIG. 2 is a partial view in section along line II—II in FIG. 1, showing that the lining adheres to the walls of the packing.

The package represented in FIGS. 1 and 2 is constituted by a parallelopipedal tray 10 of corrugated cardboard of a known type. It comprises a bottom 12, longitudinal walls 14 and transverse walls 16 articulated to the bottom by fold lines and erect relative to this bottom. The grooves of the corrugated cardboard are oriented so that when the walls are erect the grooves 18 of the longitudinal walls will be vertical.

At the ends of the transversal walls 16, flaps 20 are articulated by fold lines, these flaps fitting in the corners of the tray. These flaps are in turn prolonged by lateral wings 22 which are applied and glued against the inner face of the longitudinal walls 14.

Along the upper edge of the transverse walls of the tray there are flange members 24 which are folded inward to occupy a position parallel to the bottom 12. These flange members are held in this position by means of tabs 26 articulated at their ends and glued or fastened on the outer faces of the longitudinal walls.

According to the invention, the tray is made impermeable inside by means of a lining 28 of thermoplastic film. For this the tray, which is first expanded, is placed inside a mold. Then the film is heated to its softening point and introduced into the tray, for example by suction or blowing, so that it applies without discontinuity on the bottom 10, the side walls 14, 16, 20, and on the under face of the flange members 24, and then is folded over to apply on the upper face of the latter.

The initial lining sheet is preferably oversized so that the peripheral strip of film 30 covering the upper face of the flange members 24 and the upper edges of the longitudinal walls 14 will project to the outside beyond the latter. On this peripheral strip a cap 32 of thermoplastic material is heat-sealed to insure the seal of the tray.

If the inner lining 28 is made of flexible, easily crushed thermoplastic film, it is necessary to adhere it to the cardboard of the tray so that it cannot be removed from the latter. For this, as shown in FIG. 2, lines, dots or a mist 34 of adhesive coating can be imprinted on the inner surface of the cardboard, this coating being activated by the temperature of the film at the time of the thermal molding. It is also possible to use a film with an adhesive agent on one side, which is reactivated as the film is heated.

Figure 3:
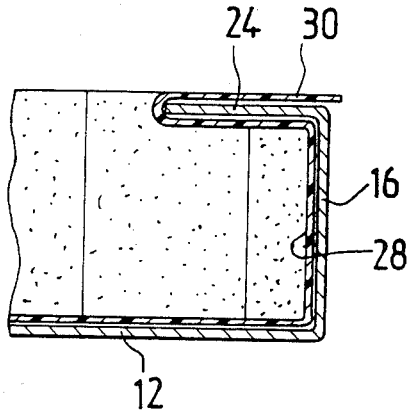
FIG. 3 is a partial view in section of a variation of the above embodiment shown in FIG. 1 in which the thermoplastic film does not adhere to the walls of the packing.

However if the lining 28 is semirigid (FIG. 3), it is not necessary to adhere it to the cardboard, since it is self-locking inside the tray. As a matter of fact, if an attempt is made to separate the lining from the tray by pulling on the peripheral strip 30, the portions of the lining embedded under the flange members are held by the latter. These portions of the lining prove difficult to force through the opening defined between the copings by reason of their relative rigidity. Nevertheless, it goes without saying that the lock can be reinforced by means of a plurality of lines of adhesive imprinted for example on the bottom 12 of the tray.

Figure 4:
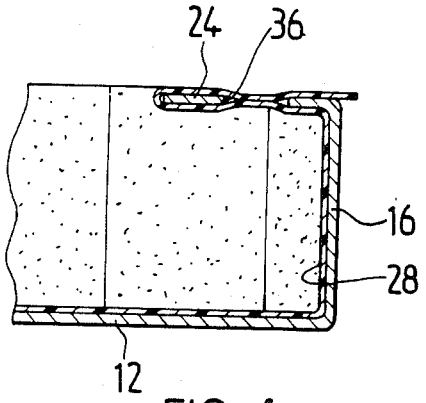
FIG. 4 represents a partial view in section of another variation of the above embodiment of the package in FIG. 1.

As shown in FIG. 4, the integration of the lining 28 with the tray can be further reinforced by forming apertures or cutouts 36 on the flange members 24. In the course of the thermal molding the surfaces of the film which are opposite one another through the apertures and situated on the two faces of the flange members are welded together.

Figure 5:
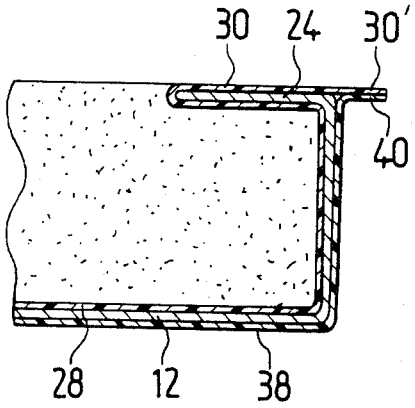
FIG. 5 is a perspective view of another type of package which is made impermeable inside and outside.

In the variation of embodiment of FIG. 5, the cardboard packing is protected not only on the inside by the lining 28 described above, but also on the outside by a lining in the form of a shell 38 of thermoplastic material applied on the outer faces of the bottom 12 of the side walls. The shell terminates at its upper edge in a peripheral flange 40 extending laterally outward parallel to the bottom. This flange is heat-sealed to the flange 30 of the inner lining which is made to project slightly for this purpose outside of the walls of the packing at 30'.

This package is simple to produce with the aid of simple means in use in the art of thermal molding. After forming the outer shell, the cardboard cutout is introduced therein while simultaneously erecting its walls. The lining 28 is then heat-molded inside the cardboard boat thus expanded and the shell and inner lining are heat-sealed by their outside flanges 30' and 40.

What is claimed is:

1. A moisture-resistant package comprising a packing in the form of a tray made of a semirigid material and comprising a bottom (10) and side walls (14, 16) articulated by fold lines to said bottom and at least two horizontal flange members (24) articulated by fold lines along the upper edges of at least two of said side walls and extending toward the inside of the package parallel to said bottom, characterized in that it also comprises an impermeable internal lining (28) constituted by a film of thermoplastic material which is applied by thermal molding against the inside faces of the bottom and the side walls and which, without discontinuity extends against the under face of the flange members (24) and is folded over to apply against the upper face of the latter.

2. A package according to claim 1, characterized in that the lining (28) is made of semirigid thermoplastic film applied against the walls of the packing and the copings without adhering thereto.

3. A package according to claim 1, characterized in that the lining (28) is made of flexible thermoplastic film and is integrated with the walls of the packing.

4. A package according to claim 3, characterized in that the lining is integrated with the packing by means of lines, dots or a mist of adhesive coating (34) deposited on the inner faces of the walls of the packing.

5. A package according to claim 3, characterized in that the lining is integrated with the packing by the fact that the film used has a layer of adhesive binder on one of its faces.

6. Package according to claim 3, characterized in that the flange members include apertures (36), the portions of film facing said apertures and situated on the under and upper faces of the flange members become welded together during the thermal molding.

7. Package according to claim 1, characterized in that the cardboard package is also protected by an outer lining (38) of thermoplastic material in the form of a sheathing applied against the outer faces of the bottom and the side walls of the package and terminating at its upper edge in a peripheral flange (40) parallel to the bottom and projecting laterally outward, the peripheral portion of the internal lining that covers the outer faces of the flange members and the upper edges of the other walls of the package also projecting outside the latter to form a projecting peripheral flange (30), said flanges of the outer sheathing and the interior lining being heat-sealed together.

8. Package according to claim 1, characterized in that the internal lining of thermoplastic film forms, above the flange members and the upper edges of the walls, a peripheral flange (30) having a cap (32) of thermoplastic material heat-sealed thereon.

9. A package according to claim 1, characterized in that said semirigid material is corrugated cardboard.

* * * * *